US005828038A

United States Patent [19]

Logan

[11] Patent Number: 5,828,038

[45] Date of Patent: Oct. 27, 1998

[54] REPLACEABLE AND RETRACTABLE BURNER FOR ELECTRIC RANGE

[75] Inventor: Eugene T. Logan, Salina, Kans.

[73] Assignee: Sigma Industries, Inc., Salina, Kans.

[21] Appl. No.: 909,620

[22] Filed: Aug. 12, 1997

[51] Int. Cl.[6] ..... H05B 3/68

[52] U.S. Cl. ..... 219/444; 219/456

[58] Field of Search ..... 219/444, 454, 219/455, 456, 458, 463, 467, 416, 418

[56] References Cited

U.S. PATENT DOCUMENTS

| | | | |
|---|---|---|---|
| 1,399,696 | 12/1921 | De Roo . | |
| 1,825,406 | 9/1931 | Lipham . | |
| 2,528,579 | 11/1950 | Clark | 219/35 |
| 2,615,118 | 10/1952 | Kelly | 219/37 |
| 2,635,172 | 4/1953 | Rutenber | 210/37 |
| 2,664,495 | 12/1953 | Wehrli | 219/43 |
| 2,701,837 | 2/1955 | Long | 219/37 |
| 2,716,697 | 8/1955 | Grannan | 219/37 |
| 2,761,053 | 8/1956 | Schneider | 219/37 |
| 2,825,790 | 3/1958 | Sims . | |
| 3,384,736 | 5/1968 | Nowosielski | 219/456 |
| 3,440,406 | 4/1969 | Sego, Jr. . | |
| 3,578,951 | 5/1971 | ingrao | 219/444 |
| 3,700,856 | 10/1972 | Kuhllman et al. | 219/451 |
| 3,761,680 | 9/1973 | Ingrao | 219/456 |
| 3,898,430 | 8/1975 | Sego, Jr. et al. | 219/444 |
| 4,206,341 | 6/1980 | Leuschner et al. . | |
| 5,084,609 | 1/1992 | Logan | 219/459 |
| 5,136,142 | 8/1992 | Logan | 219/461 |

FOREIGN PATENT DOCUMENTS

| | | | |
|---|---|---|---|
| 2160969 | 1/1986 | United Kingdom | F24C 15/10 |

*Primary Examiner*—Teresa J. Walberg
*Assistant Examiner*—Sam Paik
*Attorney, Agent, or Firm*—Head, Johnson & Kachigian

[57] ABSTRACT

A device capable of replacing existing heating elements in electric stoves. The device requires no modification of existing electric stoves. The device enables a user to raise and lower the burner element in an electric range. To facilitate the raising and lowering of the burner element, cookware is supported upon a plurality of vessel support tabs. The burner element is raised and lowered in a plane parallel to the plane of the bottom surface of cookware. By lowering the burner element, the user is able to achieve radiant heat transfer for more even cooking. In addition, lowering the burner element allows the cookware to cool much more quickly without removing the cookware from the range than was possible with traditional electric ranges where the cookware rests directly upon the burner element.

19 Claims, 6 Drawing Sheets

REPLACEABLE AND RETRACTABLE BURNER FOR ELECTRIC RANGE

BACKGROUND OF THE INVENTION

1. Field of the Invention

The present invention relates to an apparatus for use in an electric range.

2. Description of Related Art

The disadvantage of cooking with a traditional electric range is that the cookware rests directly upon the burner element. As a result, the coil-type burner element must include a relatively thick metal sheath of thickness and strength to support the cookware without deforming the element. In this type of range, the heat source cools much slower than in other types, such as gas. The electric burner element transfers heat to the cookware in the electric range, while it is the flame produced by the burning of the natural gas or propane that transfers heat in the gas range. When the electric burner is turned off, heat is still transferred to the cookware because the hot burner element and the cookware are in direct contact. This heat transfer continues until the burner element cools to room temperature. When the gas range is turned off or with less flame, the gas flow ceases and the flame is extinguished. The heat transfer ceases at the point of shutoff, and the cookware begins to cool immediately. If the desired result is to lower the intensity of the heat transfer, the user of the electric range has to take into account time required for the burner element to cool to the new temperature setting. With the gas range, decreasing the gas flow lowers the intensity of the flame, thereby immediately decreasing the heat transferred. The ability to rapidly vary the amount of heat transferred has been the major advantage of gas ranges over electric. The present invention gives the electric range this same versatility.

The following U.S. Patents are believed pertinent:

| | | |
|---|---|---|
| 1,399,696 | 12/06/1921 | C. P. De Roo |
| 1,825,406 | 08/29/1931 | Lipham |
| 2,528,579 | 11/07/1950 | E. K. Clark |
| 2,635,172 | 04/14/1953 | E. A. Rutenber |
| 2,664,495 | 12/29/1953 | A. Wehrli |
| 2,761,053 | 08/28/1956 | F. H. Schneider |
| 2,825,790 | 03/04/1958 | R. J. Sims |
| 3,440,406 | 04/22/1969 | Sego, Jr. |
| 3,700,856 | 10/24/1972 | Kullman |
| 3,578,951 | 05/18/1971 | Ingrao |
| 3,898,430 | 08/05/1975 | Sego et al |
| 4,206,341 | 06/13/1980 | Leuschner et al |
| 5,084,608 | 01/28/1992 | Logan |
| 5,136,142 | 08/04/1992 | Logan |

Many of these patents are directed to deep well devices wherein the lower heating element could move up and down but would always maintain contact with the cookware. This is the case in the patents of Wehrli, Lipham, and Schneider.

The patents of Sims, Rutenber, and Clark relate to devices in which the heating element can be moved from a lower position to an upper position for use either as a deep well cooker or a regular top heating element, respectively. However, the cookware maintains constant direct contact with the heating element in these devices also.

The De Roo patent discloses an electric heater device used in an apparatus for determining the amount of moisture in a product which heats a receptacle containing the product to be tested. The electric heater device is immediately released and automatically moved away from the receptacle when the heat rises above a predetermined degree, thus ceasing heat transfer.

The Leuschner et al. patent discloses a warming plate wherein the heating element can be pivoted about a point such that the element makes an arcuate motion about a fixed point up to and away from the surface of the warming plate.

In Kullman, the heating element and all of the utensil support members are locked together with the trim ring, all of which are pivotally connected to the stove. The heating element is pivoted relative to the pan, i.e., it does not raise and lower axially vertically.

Ingrao is a vertically movable heating element using a complex linkage, diversion baffling, splash pans, etc., to prevent food spillage from contacting the linkage.

Sego et al. '430 provides a vertically movable hot plate level adjuster which is held together by a center threaded nut. Solenoid actuated mechanisms raise and lower the heating element via rotation of a circular cam and follower mechanism.

Sego Jr. '406 shows an early form of hot plate level adjuster using an electromagnet.

Finally, Applicant's previously patented inventions, U.S. Pat. No. 5,084,608 for a Retractable Burner for an Electric Range Having a Removable Burner Element and U.S. Pat. No. 5,136,142 for an Electric Burner for an Electric Range are for devices that require a specially modified or designed electric range to accommodate the raising and lowering mechanisms of the device.

Absent from the prior art is a retractable burner device for an electric range wherein the device may be used with an existing electric range without the requirement of any modifications to the existing electric range.

SUMMARY OF THE INVENTION

It is therefore an object of the invention to provide a unit that is adaptable to replace an existing heating element in an electric stove which does not require that the unit be connected to the stove body or that the stove body be modified.

A further object of the invention is to maintain consistent uniform heating of the cookware while being able to remove the electric burner element from direct contact with the cookware.

A further object of the invention results in an electric heating element having a thinner metal sheath than that of the prior art since it is not necessary for the element to support the cookware.

A further object of the invention is to provide a Retractable Burner for an Electric Range which allows the user to raise and lower the heating element independently of the cookware that is being heated by that burner element.

In this invention, cookware is supported by a plurality of support tabs instead of the burner element. The support tabs are fixed to a vessel support assembly which rests upon a rim area provided in a drip pan. The drip pan is placed in a standard range top orifice. Therefore, the support tabs stay at a fixed level with respect to the range while the burner element can be raised and lowered with respect to the top of the vessel support tabs.

A retractable element support assembly supports a heating element and is positioned above the vessel support assembly. The element support assembly is raised and lowered by cam springs. The cam springs are affixed to a rotatable cam plate. By rotating the cam plate, the element support assembly and burner element are selectively raised or lowered. In the preferred embodiment, when the heating elements are raised to their top position, the burner element is positioned about 1/16th of an inch above the vessel support tabs. The weight of the cookware compresses the cam springs and lowers the heating elements such that the pan or vessel rests upon the support tabs. The cam spring maintains constant contact with the heating element against the bottom of the cookware at this position. When the heating element is lowered, the heating element is approximately 1/8th inch below the top of the support tabs, and therefore does not make contact with the cookware. These dimensions are given as an example only and are not to be limiting.

The present invention can be used with a traditional electric range simply by removing the existing electric heating assembly, and replacing the existing electric heating assembly with the improved retractable burner assembly of the present invention. No modification of the range is required. The retractable burner assembly provides the user with the option of obtaining substantially the same rapid cooling characteristic that is obtainable with the use of a gas range. By uniformly supporting the cookware on vessel support tabs above a lowered electric burner element in a parallel plane, heat transfer to the bottom surface of the cookware is reduced. In a lowered position, the heating element provides gentle heat (radiant) which is useful for simmering foods such as puddings, sauces, gravies or soups. Any combination of heating modes can be obtained where the burner element can be raised or lowered at any heat setting. Although two (2) settings up and down of the burner element are disclosed, the invention includes settings therebetween.

DETAILED DESCRIPTION OF THE PREFERRED EMBODIMENTS

Figure 1:
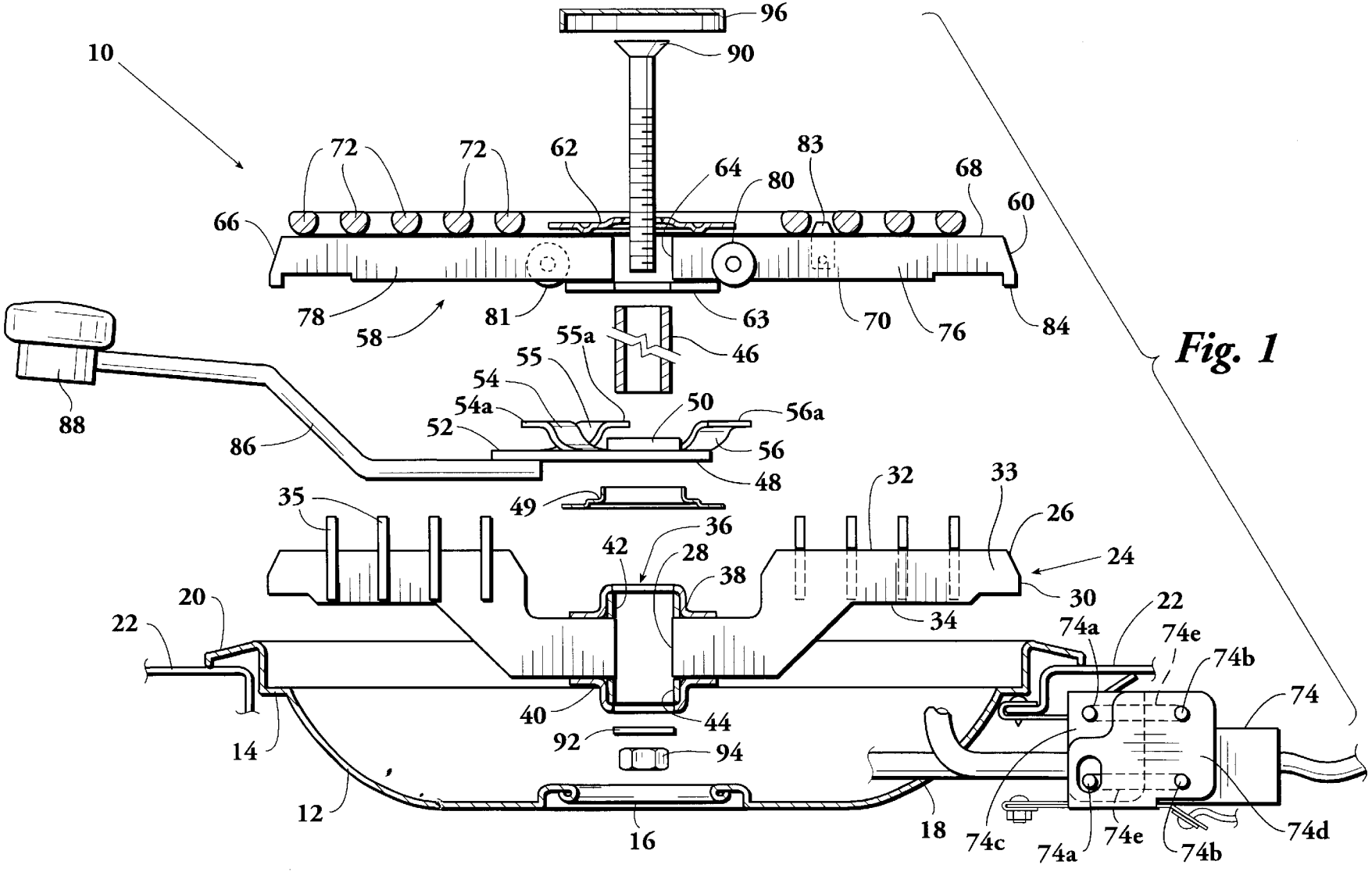
FIG. 1 is an exploded view of the invention.

Reference is made to FIG. 1, which shows an exploded view of the Retractable Burner Assembly designated generally 10. Retractable Burner Assembly 10 is designed to fit into a standard range top orifice. Drip pan 12 is provided to replace the existing drip pan on a standard range top. Drip pan 12 possesses rim area 14, lower orifice 16 and side orifice 18. Periphery 20 of drip pan 12 is supported by existing range top 22.

Vessel support assembly 24 includes a plurality of vessel support arms 26. Vessel support arms 26 have inside end 28, outside end 30, upper surface 32, side surface 33, and lower surface 34. Affixed to side surface 33 of vessel support arms 26 and extending above upper surface 32 are a plurality of vessel support tabs 35. Vessel support arm inside end 28 is affixed to vessel support assembly hub 36. In the preferred embodiment, the vessel support assembly hub is comprised of upper plate 38, lower plate 40, upper ring 42 and lower ring 44.

In the preferred embodiment, three or more vessel support arms 26 are affixed to vessel support assembly hub 36 in a hub and spoke arrangement. Upper wear ring 42 and lower wear ring 44 are in contact with upper surface 32 and lower surface 34 of inside end 28 of vessel support arm 26. The entire vessel support assembly 24 is supported by outside end 30 of vessel support arms 26, which rest on rim area 14 of drip pan 12.

An alignment means, preferably burner assembly sleeve 46, is positioned within the vessel support assembly hub 36. However, other alignment means may be used, including a bolt or other means. Cam plate 48, having a central orifice 50, is positioned above vessel support assembly 24 and is positioned around burner sleeve 46. In the preferred embodiment, cam plate 48 is shaped to be complementary to upper wear plate 38. Cam plate 48 is also complementary to and supported by wear plate 49, which engages upper wear plate 38 and is rotatable thereabout. Positioned on upper surface 52 of cam plate 48 is a biasing means. In the preferred embodiment, the biasing means comprises three cam springs, first cam spring 54, second cam spring 55, and third cam spring 56. However, other numbers of cam springs, such as two cam springs, may be used as well. In the preferred embodiment, the cam springs are flexible metal strips, preferably Inconel, which are affixed at one end to upper surface 52 of cam plate 48. An elevated end of cam springs 54, 55 and 56 extend above cam plate 48. Preferably, cam springs 54, 55 and 56 are positioned such that the strips are elevated from fixed end to elevated end in a clockwise direction, thereby acting to elevate an object in contact with cam springs 54, 55 and 56 when cam plate 48 is rotated in a counter-clockwise direction. Terminal areas 54*a*, 55*a*, and 56*a* are preferably provided on an upper end of cam springs 54, 55 and 56, respectively. Terminal areas 54*a*, 55*a*, and 56*a* are discussed in greater detail with reference to FIG. 6.

Element support assembly 58 is comprised of a plurality of element support arms 60. In the preferred embodiment, three element support arms 60 are arranged about upper support disk 62 and lower support disk 63 in a hub and spoke arrangement. Upper support disk 62 and lower support disk 63 define a central orifice. Element support assembly members 60 are comprised of inside end 64, outside end 66, upper surface 68, and lower surface 70. Element support assembly upper surface 68 is for supporting heating element 72. In the preferred embodiment, a modified canning-type element is used. Typically, heating element 72 is a heating coil supported by the plurality of element support arms 60. Heating element 72 extends downwardly and through side orifice 18 of drip pan 12 to make an electrical connection with existing receptacle 74. Stove receptacle 74 should be vertically adjustable to permit the elevation of heating element 72. In the preferred embodiment, stove receptacle 74 is provided with links 74*a* and 74*b*. Links 74*a* pass through holes provided for them in receptacle support 74*c*. Receptacle support 74*c* is preferably fixed to existing range top 22. Links 74*b* pass through holes provided for them in receptacle holder 74D. Receptacle support 74*c*, however, loosely engages links 74*a*, thereby permitting receptacle holder 74*d* to be vertically adjustable with respect to receptacle support 74*c*. Links 74*a* and 74*b* are connected together by link arms 74*e*. Link arms 74*e* prevent receptacle holder 74*d* from disengaging from receptacle support 74*c*.

Preferably affixed to each of a first element support arm 76, a second element support arm 78, and a third element support arm 79, is an engagement means for contacting cam springs 54, 55 and 56. In the preferred embodiment, the engagement means is first wear button 80, second wear button 81, and third wear button 82. Wear buttons 80, 81 and 82 are affixed to first, second and third element support arms 76, 78 and 79, respectively, and extend below lower surface 70 of element support arms 76, 78 and 79.

Element support assembly 58 is slidably engaged with burner assembly sleeve 46 and is supported by cam springs 54, 55 and 56. By rotating cam plate 48, the user may variably elevate element support assembly 58. To prevent excessive rotational movement of element support assembly 58, wear tab 83 is preferably affixed to element support assembly 58. Wear tab 83 slides against an edge of a vessel support tab 35 to stop excessive rotational movement of element support assembly 58. When element support assembly 58 is in a lowered position, lower position stop 84 rests on rim area 14 of drip pan 12. A means for rotating cam plate 48, such as adjustment lever 86, with knob 88 affixed thereto, is provided so that the user may adjust the height of element support assembly 58. To secure retractable burner assembly 10 together as a unit vessel support assembly 24, cam plate 48 and element support assembly 58 are secured by burner assembly thru-bolt 90, which is positioned within burner assembly sleeve 46. Washer 92 and nut 94 are secured to burner assembly thru-bolt 90 to prevent vessel support assembly 24 from becoming disengaged from burner assembly thru-bolt 90. Finally, medallion 96 is positioned on upper surface 68 of element support assembly 58 to conceal the top of burner assembly thru-bolt 90, thereby providing a more attractive appearance for retractable burner assembly 10.

Figure 2:
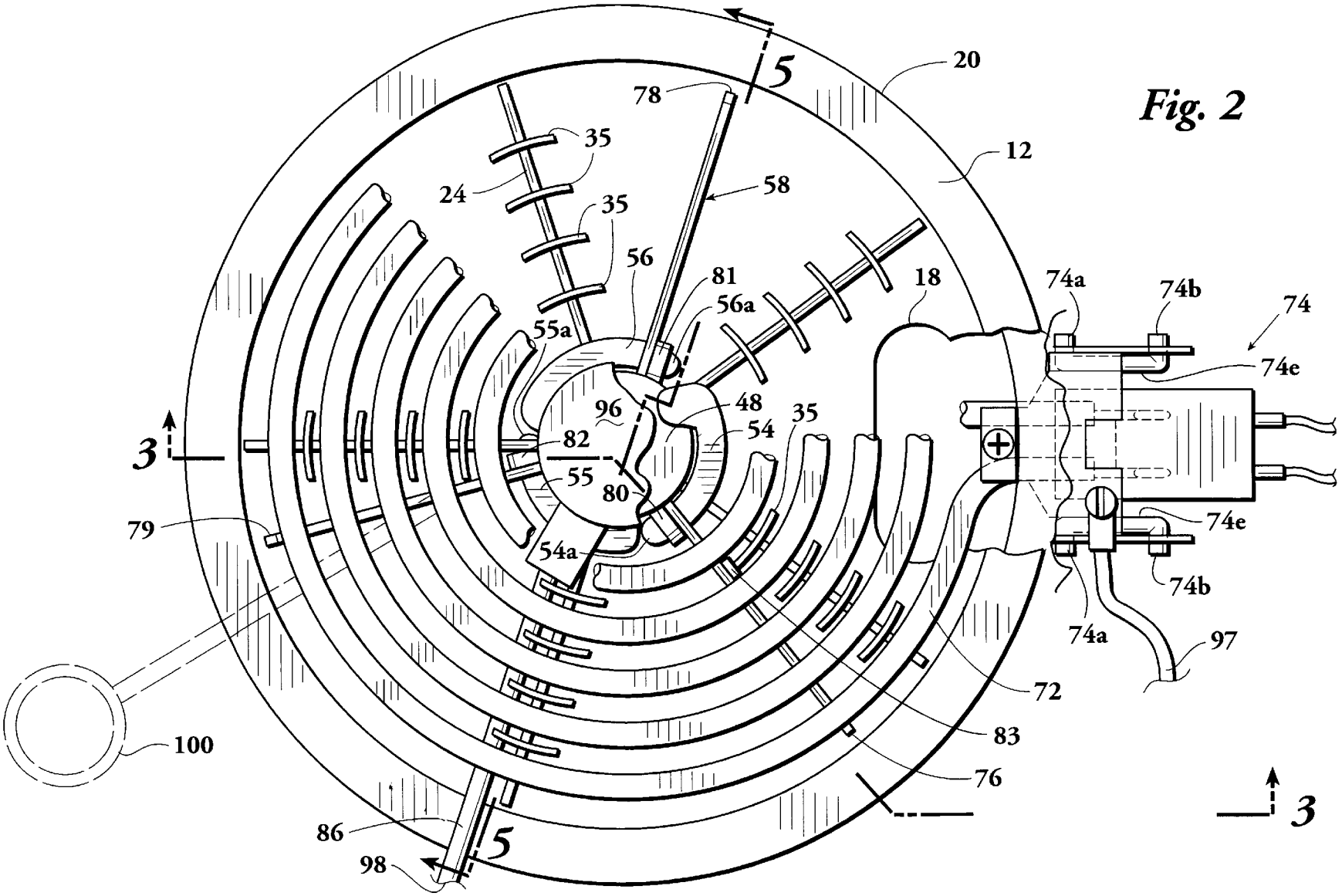
FIG. 2 is a top-elevation view of the invention.

Now referring to FIG. 2, a top view of retractable burner assembly 10 is shown. Visible is periphery 20 of drip pan 12. Vessel support assembly 24 is below heating element 72 and vessel support tabs 35 protrude through voids in heating element 72. Wear tab 83 is shown engaging a vessel support tab 35 affixed to first element support arm 76 of element support assembly 58. Element support assembly 58 is shown supporting heating element 72. Heating element 72 passes through side orifice 18 in drip pan 12 to make connection with existing stove receptacle 74. Ground wire 97 connects to existing stove receptacle 74. Wear buttons 80, 81 and 82 are shown supported by cam springs 54, 55 and 56. Visible beneath medallion 96 is a portion of cam plate 48 with adjustment lever 86 attached thereto. Adjustment lever 86 is shown in raised position 98 and also in lowered position 100.

Figure 3:
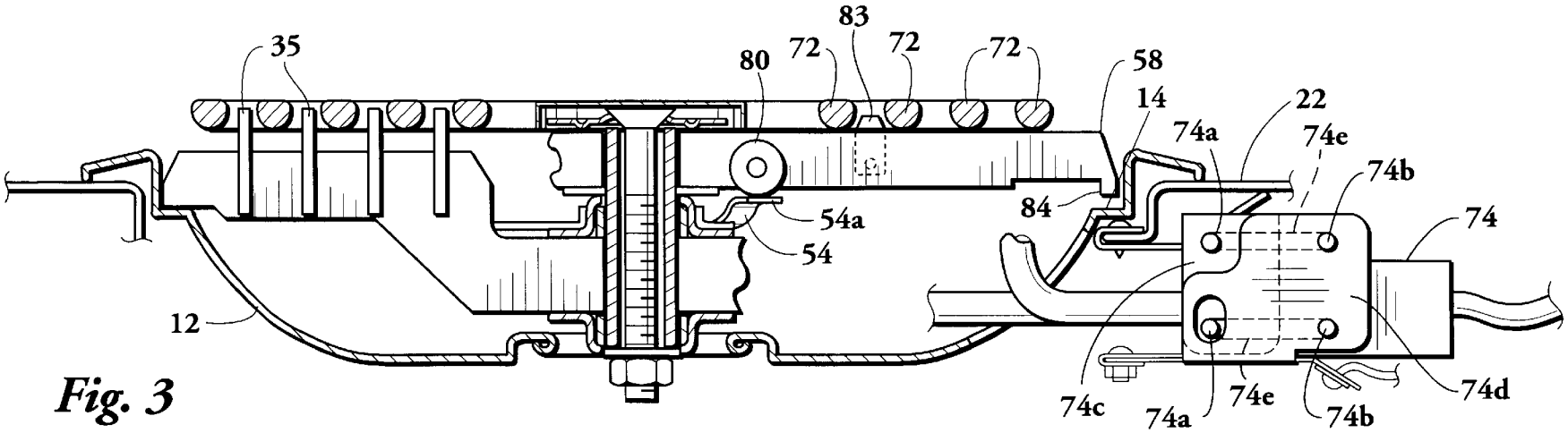
FIG. 3 is a view taken along line 3—3 of FIG. 2, showing the burner element in the raised position and showing the burner receptacle in the raised position.

Referring now to FIG. 3, a side view taken along line 3—3 of FIG. 2 of retractable burner assembly 10 is shown. Note that element support assembly 58 is in a raised position. Heating element 72 is positioned above vessel support tabs 35 for making contact with cookware. Element support assembly 58 is preferably supported by terminal areas 54*a*, 55*a* and 56*a* of cam springs 54, 55 and 56 (cam spring 54 and terminal area 54*a* shown in FIG. 3), via wear buttons 80, 81 and 82 (wear button 80 shown in FIG. 3). Note that lowered position stop 84 is not resting on rim area 14 of drip pan 12. Also visible is stove receptacle 74 with receptacle holder 74*d* shown in a raised position.

Figure 4:
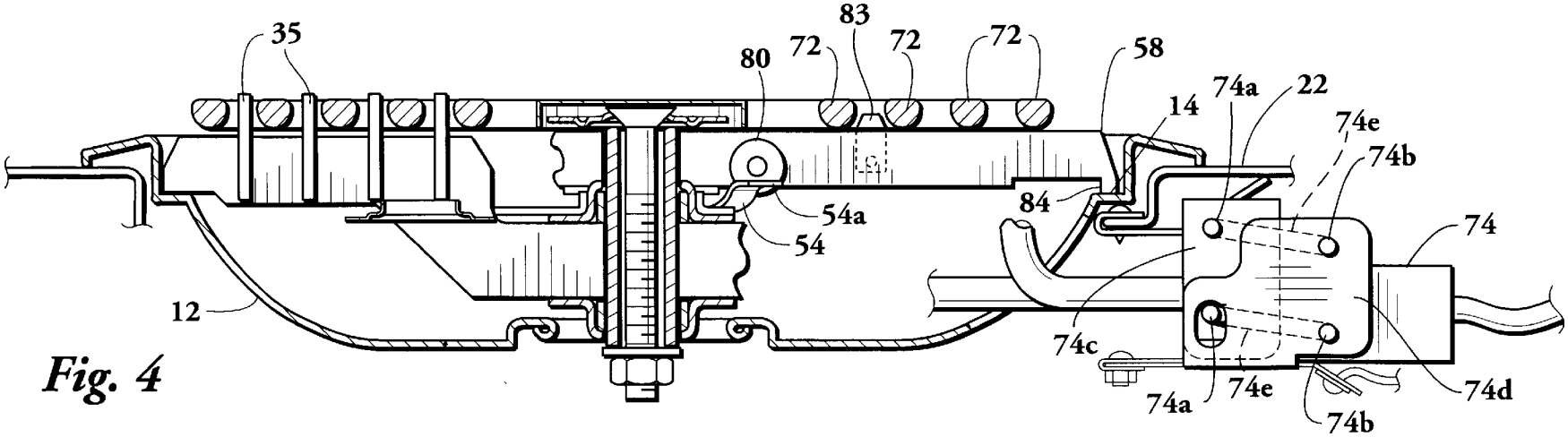
FIG. 4 is a view taken along line 3—3 of FIG. 2, showing the burner element in the lowered position and showing the burner receptacle in the lowered position.

Shown in FIG. 4 is a side view, also taken along line 3—3 of FIG. 2, of assembled retractable burner assembly 10. FIG. 4, however, shows the element support assembly 58 in a lowered position. Note lower position stop 84 is resting on rim area 14 of drip pan 12. Consequently, heating element 72 is shown below the tops of vessel support tabs 35, thereby disengaging the cookware from heating element 72. Also visible is stove receptacle 74 with receptacle holder 74*d* shown in a lowered position.

Figures 5, 6:
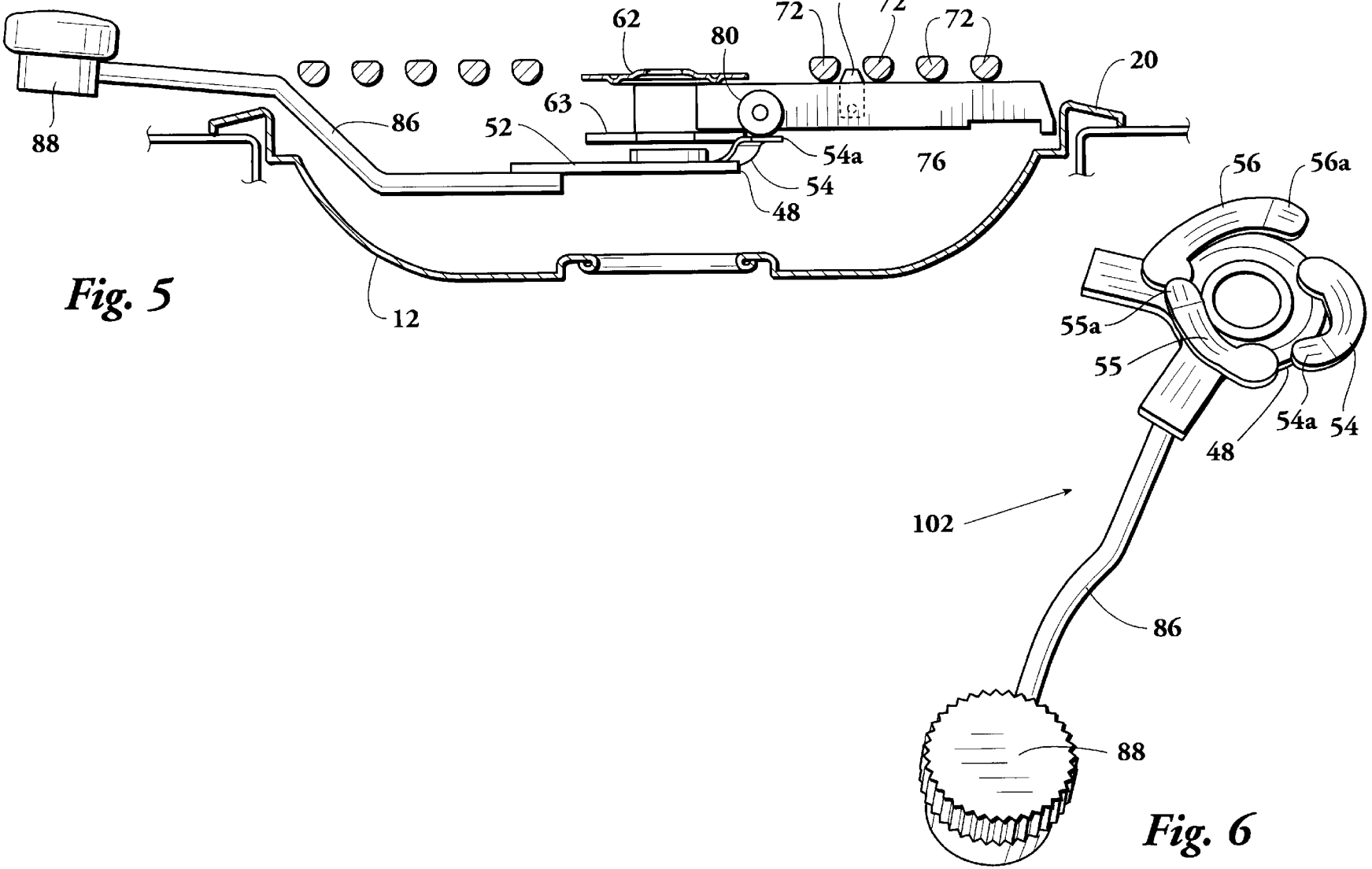
FIG. 5 is a view taken along line 5—5 of FIG. 2, showing a partial side-sectional view of the invention in the raised position.
FIG. 6 is a perspective view of the cam plate-lever assembly.

Referring now to FIG. 5, a partial side view taken along line 5—5 of retractable burner assembly 10 is shown. Affixed to upper surface 52 of cam plate 48 is first cam spring 54. First cam spring 54 is supporting first wear button 80, which is affixed to element support arm 76. Adjustment lever 86 is shown affixed to cam plate 48. Adjustment lever 86 passes beneath heating element 72 and above the periphery 20 of drip pan 12, terminating at knob 88.

Referring now to FIG. 6, shown is a perspective view of lifting assembly 102 comprised of cam plate 48, first, second and third cam springs 54, 55 and 56, adjustment lever 86 and knob 88. Visible in FIG. 6 are terminal areas 54*a*, 55*a* and 56*a*, positioned on cam springs 54, 55 and 56, respectively. Terminal areas 54*a*, 55*a* and 56*a* support and hold first wear button 80, second wear button 81, and third wear button 82, thereby supporting element support assembly 58 when adjustment lever 86 is in the raised position 98. Terminal areas 54*a*, 55*a* and 56*a* are preferably fashioned on cam springs 54, 55 and 56 such that terminal areas 54*a*, 55*a* and 56*a* are parallel to cam plate 48.

Figure 7:
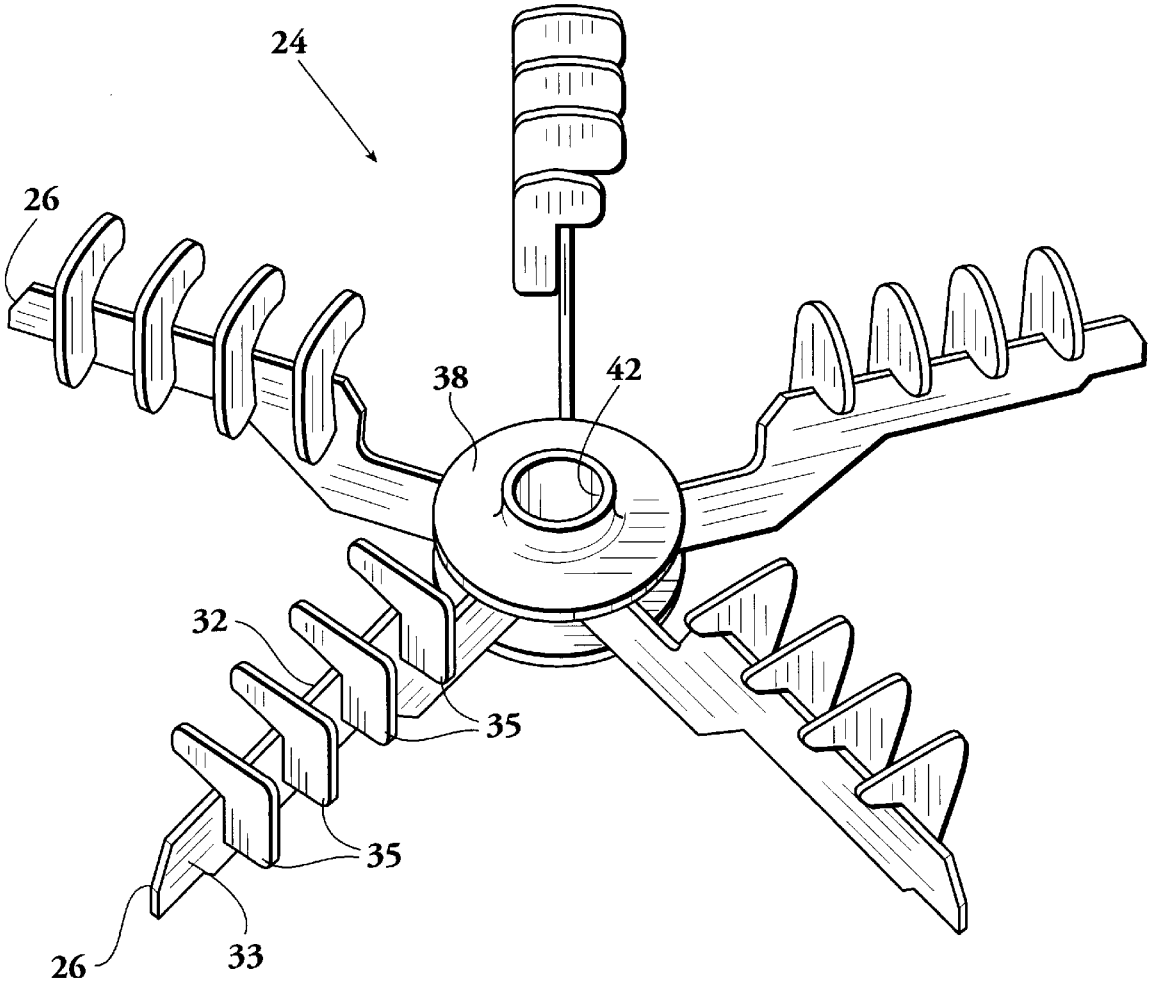
FIG. 7 is a perspective view of the vessel support assembly.

FIG. 7 shows a perspective view of vessel support assembly 24. Visible are five vessel support arms 26, each with vessel support tabs 35 affixed on side surface 33 of vessel support arms 26. Upper plate 38 surrounds vessel support assembly upper ring 42. Vessel support assembly upper ring 42 is for receiving burner assembly sleeve 46 as shown in FIG. 1.

Figure 8:
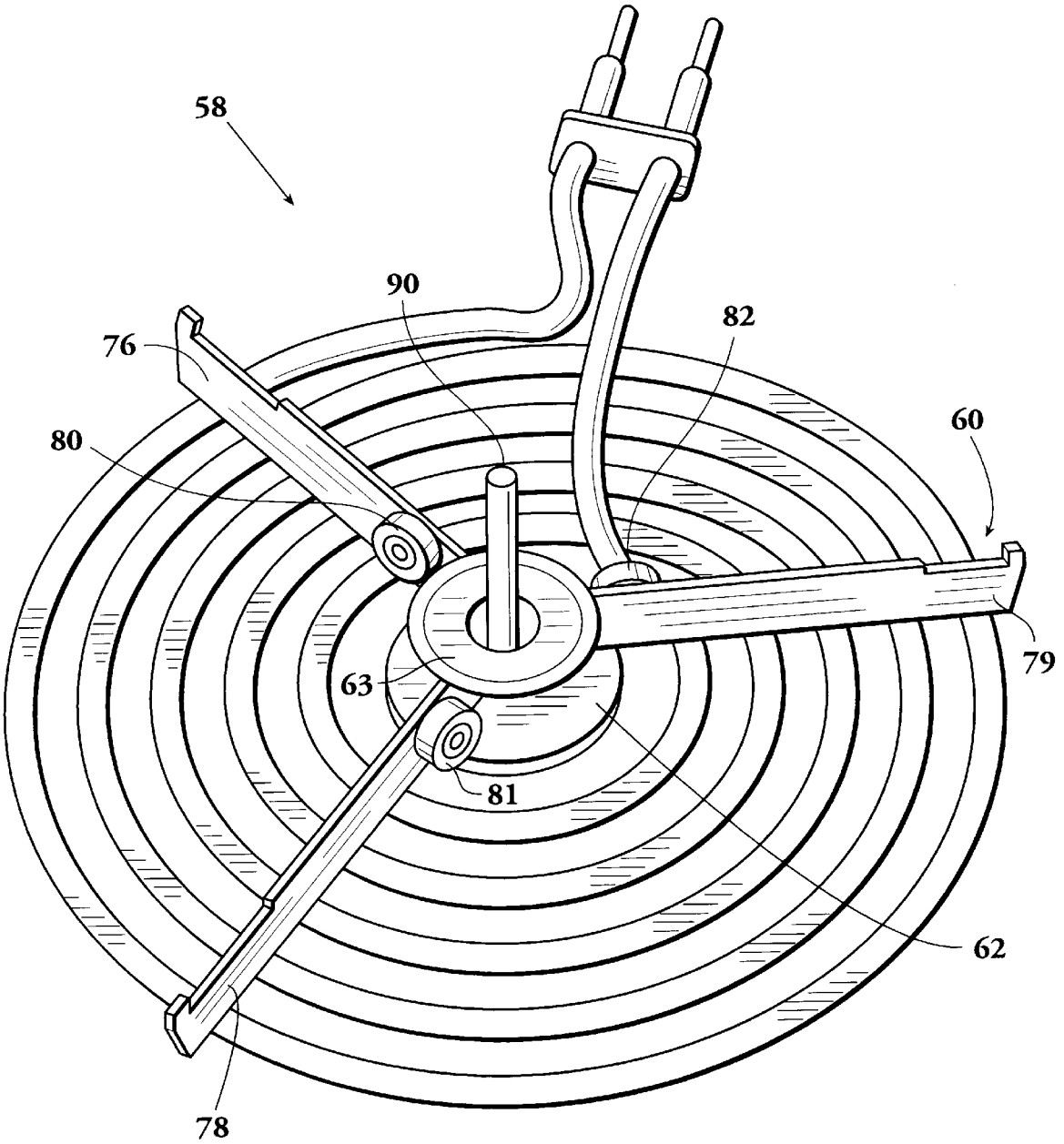
FIG. 8 is a perspective view of the bottom of the element support assembly.

Finally, FIG. 8 shows a bottom view of element support assembly 58 comprised of three element support arms designated generally 60. More specifically, element support arms 60 include first element support arm 76, second element support arm 78 and third element support arm 79, affixed to upper support disk 62 and lower support disk 63. Burner assembly thru-bolt 90 is shown extending through lower support disk 63. First wear button 80, second wear button 81, and third wear button 82 are shown affixed to element support arms 60.

In a typical use of the invention, an existing heating element in an electric stove may be removed and replaced with retractable burner assembly 10. No modification to the existing electric stove is required. Cookware and its contents are placed on retractable burner assembly 10. Cookware is supported by vessel support assembly 24 via the plurality of vessel support tabs 35. Element support assembly 58, supporting heating element 72, is raised to a position wherein heating element 72 is in direct contact with the bottom of the cookware. In the preferred embodiment, the raising and lowering of heating element 72 occurs by rotating cam plate 48 via adjustment lever 86 and knob 88. By rotating cam plate 48, first, second and third cam springs 54, 55 and 56 rub against first, second and third wear buttons 80, 81 and 82. By rotating adjustment lever 86 to raised position 98, heating element 72 is raised to its top position. In the preferred embodiment, raised position 98 places heating element 72 about 1/16th inch above vessel support tabs 35. In raised position 98, the weight of the cookware will compress cam springs 54, 55 and 56, thereby lowering heating elements 72 to the level of vessel support tabs 35. The cookware then rests upon vessel support tabs 35. Even so, when adjustment lever 86 is in raised position 98, cam springs 54, 55 and 56 maintain constant contact between heating element 72 and the cookware by applying an upward force on wear buttons 80, 81 and 82, which are affixed to element support assembly 58.

When element support assembly 58, and therefore heating element 72, is in lowered position 100, heating element 72 will then be about ⅛th inch below the top of vessel support tabs 35. By applying heat to the cookware when the element support assembly 58, and therefore heating element 72, is in raised position 98, the contents may be heated with conductive heat. When element support assembly 58, and therefore heating element 72, is in lowered position 100, the cookware is subject only to radiant heat. This substantially instantaneous reduction of heat is not possible with conventional electric range tops. By lowering the heating element away from the cookware, boiling contents are known to instantly begin to simmer. Previously this was only possible by use of a gas range.

Thus, it will be appreciated that as a result of the present invention, a highly effective replaceable and retractable burner for electric ranges is provided. It is contemplated and will be apparent to those skilled in the art from the preceding description and the accompanying drawings, that modifications and/or changes may be made in the illustrated embodiment without departure from the present invention. Accordingly, it is expressly intended that the foregoing description and accompanying drawings are illustrative of preferred embodiments only, not limiting, and that the true spirit and scope of the present invention will be determined by referenced to the appended claims.

What is claimed is:

1. A removable, self-contained surface heating assembly for installation in existing electric ranges, said surface heating assembly comprising:

an element support assembly;

a heating element on said element support assembly, said heating element having voids;

a vessel support assembly having an upper surface and positioned below said element support assembly in a first up position of said heating element, said vessel support assembly having a plurality of vessel support tabs projecting above said upper surface when in a second down position of said heating element, said vessel support tabs for passing through said voids in said heating element for supporting cookware; and a raising and lowering means positioned between said element support assembly and said vessel support assembly for raising and lowering said element support assembly with respect to said vessel support assembly.

2. A removable, self-contained surface heating assembly according to claim 1, wherein said raising and lowering means is comprised of:

a rotatable cam plate positioned between said vessel support assembly and said element support assembly; and a biasing means positioned on said cam plate, said biasing means for selectively elevating said element support assembly.

3. A removable, self-contained surface heating assembly according to claim 1, further comprising a wear tab affixed to said element support assembly, said wear tab for slidingly engaging said vessel support assembly to restrict rotation of said element support assembly.

4. A removable, self-contained surface heating assembly according to claim 1, further comprising a means to removably connect said heating element to an existing receptacle.

5. A removable, self-contained surface heating assembly according to claim 4, wherein said means to removably connect is a vertically adjustable receptacle means comprising a receptacle holder slidably engaged on a stationary receptacle support.

6. A surface heating assembly for installation in existing electric ranges, said surface heating assembly comprising:

a vessel support assembly comprised of a plurality of vessel support arms having an inside end, an outside end, an upper and a lower surface and affixed to a vessel support assembly hub;

a plurality of vessel support tabs affixed to said vessel support arms and extending above said upper surface;

an alignment means for passing through said vessel support assembly hub;

a cam plate having an upper surface, said cam plate defining a centrally located orifice, said centrally located orifice positioned about said alignment means, said cam plate rotatable about said alignment means, said cam plate positioned above said vessel support assembly;

an element support assembly, said element support assembly comprised of a plurality of element support arms radially assembled about a central orifice, said vessel support arms having an inside end, an outside end, an upper surface, and a lower surface, said central orifice slidably positioned on said alignment means above said cam plate, said lower surface of said outside ends for supporting said element support assembly when said element support assembly is in a lowered position;

an engagement means located on said lower surface of said element support arms for engaging a biasing means, said biasing means affixed to said upper surface of said cam plate for contacting said engagement means, said biasing means for variably elevating said element support assembly depending on the rotational orientation of said cam plate;

a heating element positioned on said upper surface of said element support arms, said heating element having an outer periphery; and a means for rotating said cam plate, thereby raising or lowering said element support assembly.

7. A heating assembly according to claim 6, wherein said alignment means is a burner assembly sleeve.

8. A heating assembly according to claim 6, further comprising a thru-bolt positioned within said burner assembly sleeve and extending outwardly therefrom, said thru-bolt affixed to a nut for preventing said vessel support assembly, said cam plate, and said element support assembly from disengaging from said burner assembly sleeve.

9. A heating assembly according to claim 6, further comprising stop tabs affixed to said outside ends of said lower surface of said element support arms.

10. A heating assembly according to claim 6, wherein said biasing means is a pair of cam springs for biasing against said engagement means.

11. A heating assembly according to claim 6, wherein said engagement means are a first wear button affixed to a first element support arm, said first wear button positioned above said cam plate and extending below said lower surface of said first element support arm and a second wear button affixed to a second element support arm, said second wear button positioned above said cam plate and extending below said lower surface of said second element support arm, said first wear button and said second wear button for supporting said element support assembly upon said biasing means.

12. A heating assembly according to claim 11, wherein said biasing means is a first cam spring affixed to said upper surface of said cam plate, and oriented to make contact with said first wear button, a second cam spring affixed to said upper surface of said cam plate and oriented to make contact with said second wear button, said first cam spring and said second cam spring for biasing against said wear buttons, said cam springs for variably elevating said element support assembly depending on a rotational orientation of said cam plate.

13. A heating assembly according to claim 6, wherein said heating element is a coiled canning type element.

14. A heating assembly according to claim 6, wherein said means for rotating is a lever, said lever affixed to said cam plate and extending below said heating element, said lever extending to a point beyond said outer periphery of said heating element.

15. A removable, self-contained surface heating assembly according to claim 6, further comprising a means to removably connect said heating element to an existing receptacle.

16. A removable, self-contained surface heating assembly according to claim 15, wherein said means to removably connect is a vertically adjustable receptacle means comprising a receptacle holder slidably engaged on a stationary receptacle support.

17. A surface heating assembly for installation in existing electric ranges, said surface heating assembly comprising:

a vessel support assembly comprised of a plurality of vessel support arms, a vessel support assembly upper plate, and a vessel support assembly lower plate, said vessel support arms arranged radially about said upper plate and said lower plate, said vessel support arms having an inside end, an outside end, and an upper surface, said inside ends of said vessel support arms affixed to said upper plate and to said lower plate, said vessel support assembly upper plate and said vessel support assembly lower plate aligned co-axially, said outside ends of said vessel support arms supported by said rim area of said drip pan;

a burner assembly sleeve, said burner assembly sleeve defining a central orifice, said burner assembly sleeve passing through said vessel support assembly upper plate and through said vessel support assembly lower plate;

a cam plate having an upper surface, said cam plate defining a centrally located orifice, said centrally located orifice positioned about said burner assembly sleeve, said cam plate rotatable about said burner assembly sleeve, said cam plate positioned above and supported by said vessel support assembly upper wear ring;

an element support assembly, said element support assembly comprised of a plurality of element support arms and a vessel support assembly disks, said vessel support arms arranged radially about said vessel support assembly disks and having an inside end, an outside end, an upper surface, and a lower surface, said inside ends of said element support arms affixed to said element support assembly disks, said element support assembly disks slidably positioned on said burner assembly sleeve above said cam plate, said lower surface of said outside ends of said element support arms having stop tabs thereon for supporting said element support assembly when said element support assembly is in a lowered position;

at least one wear button affixed to an element support arm, said wear button positioned above said cam plate and extending below said lower surface of said element support arm;

at least one cam spring affixed to said upper surface of said cam plate, and oriented to make contact with a corresponding wear button, said cam spring for biasing against said wear button, said cam spring for variably elevating said element support assembly depending on the rotational orientation of said cam plate;

a coiled heating element positioned on said upper surfaces of said element support arms;

a means to removably connect said heating element to an electric stove connection means; and a burner assembly thru-bolt positioned within said burner assembly sleeve and extending outwardly therefrom, said burner assembly thru-bolt secured to a nut, said burner assembly thru-bolt and nut for preventing said vessel support assembly, said cam plate, and said element support assembly from disengaging from said burner assembly sleeve.

18. A surface heating assembly according to claim 17, wherein said means to removably connect said heating element comprises a vertically adjustable receptacle means.

19. A removable, self-contained surface heating assembly according to claim 18, wherein said means to removably connect is a vertically adjustable receptacle means comprising a receptacle holder slidably engaged on a stationary receptacle support.

* * * * *